US007716830B2

(12) United States Patent
Haddock et al.

(10) Patent No.: US 7,716,830 B2
(45) Date of Patent: May 18, 2010

(54) METHOD OF MANUFACTURING A GLASS FUEL INJECTOR

(75) Inventors: Thomas F. Haddock, Ann Arbor, MI (US); Philippe Bado, Ann Arbor, MI (US); Mark Allen Dugan, Ann Arbor, MI (US); Ali Said, Ann Arbor, MI (US)

(73) Assignee: Translume, Inc., Ann Arbor, MI (US)

( * ) Notice: Subject to any disclaimer, the term of this patent is extended or adjusted under 35 U.S.C. 154(b) by 1053 days.

(21) Appl. No.: 11/247,907

(22) Filed: Oct. 11, 2005

(65) Prior Publication Data

US 2007/0241211 A1 Oct. 18, 2007

(51) Int. Cl.
*B21D 51/16* (2006.01)

(52) U.S. Cl. ..... 29/890.06; 65/31; 239/601; 347/47

(58) Field of Classification Search ..... 29/890.06; 239/601, 602; 347/47; 385/137, 134; 65/30.11, 65/31

See application file for complete search history.

(56) References Cited

U.S. PATENT DOCUMENTS 4,007,464 A * 2/1977 Bassous et al. ..... 347/47
6,990,285 B2 * 1/2006 Schroeder et al. ..... 385/137

FOREIGN PATENT DOCUMENTS

CA 2099416 1/1994

OTHER PUBLICATIONS

Watanabe, et al., "Femtosecond laser-assisted three-dimensional microfabrication in silica," *Optics Letters*, vol. 26, No. 5, pp. 277-279 (2001).

* cited by examiner

*Primary Examiner*—Rick K Chang

(57) ABSTRACT

A method and apparatus for manufacturing a fuel injector comprising a glass substrate and a nozzle enclosed within the glass substrate, wherein the nozzle comprises at least one injection hole is provided. The method of manufacturing the fuel injector comprises defining (105) a shape of at least one injection hole in a glass substrate to obtain an at least one outlined injection hole and etching (110) the at least one outlined injection hole to obtain the at least one injection hole.

11 Claims, 6 Drawing Sheets

METHOD OF MANUFACTURING A GLASS FUEL INJECTOR

FIELD OF THE INVENTION

The present invention relates to a fuel injector and a method of manufacturing the same. More specifically, the invention relates to the fuel injector made of a glass substrate and the method of manufacturing the same.

BACKGROUND OF THE INVENTION

A fuel injector is a device to inject fuels either directly or indirectly into a combustion chamber. Fuel efficiency of internal combustion engines is improved and there is reduction of undesirable engine emissions (toxic emission), using a fuel injector, as the fuel is atomized (very small drops) as it enters or prior to entering the cylinder(s).

There are many fuel injectors or such devices available to inject fuels into a combustion chamber. There are fuel injectors available that have a nozzle with apertures that is made of metal. However, the holes of the nozzle have straight or slightly tapered injection holes with diameter equal or greater to 50-microns because of manufacturing limitations. On the other hand, there are few fuel injectors or devices available with holes smaller than 50-microns diameter. Smaller size of the injection holes which is less than 50-microns enables to improve the atomization and the fuel distribution process. Also, there is no fuel injector with holes that are substantially shaped to optimize atomization and fuel mist distribution.

SUMMARY OF THE INVENTION

The invention relates to a fuel injector and a method of manufacturing the same. The manufacturing process enables creating the holes of the nozzle of the fuel injector that are less than 100-microns diameter. It also does not create micro-crack in the glass substrate. It may further eliminate pre-existing micro-cracks. It also enables the apparatus to improve fuel efficiency of internal combustion engines, the fuel is atomized (very small drops) as it enters or prior to entering the cylinder(s).

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION OF THE DRAWINGS

The present invention may be embodied in several forms and manners. The description provided below and the drawings show exemplary embodiments of the invention. Those of skill in the art will appreciate that the invention may be embodied in other forms and manners not shown below. The invention shall have the full scope of the claims and is not to be limited by the embodiments shown below.

In this document, relational terms such as "first" and "second", "top" and "bottom", and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

The invention relates to a fuel injector and a method of manufacturing the fuel injector. Pursuant to the various embodiments, the invention pertains to the fuel injector made of a glass substrate and the method of manufacturing the same. A few examples of such glass substrate can be a fused silica, a fused quartz, any oxide glass ($B_2O_3$, $SiO_2$, GeO2, $P_2O_5$, $As_2O_3$, $Sb_2O_3$, etc.) or mixture of oxide glass; or any chalcogenides or halides glass, etc.

Figure 1:
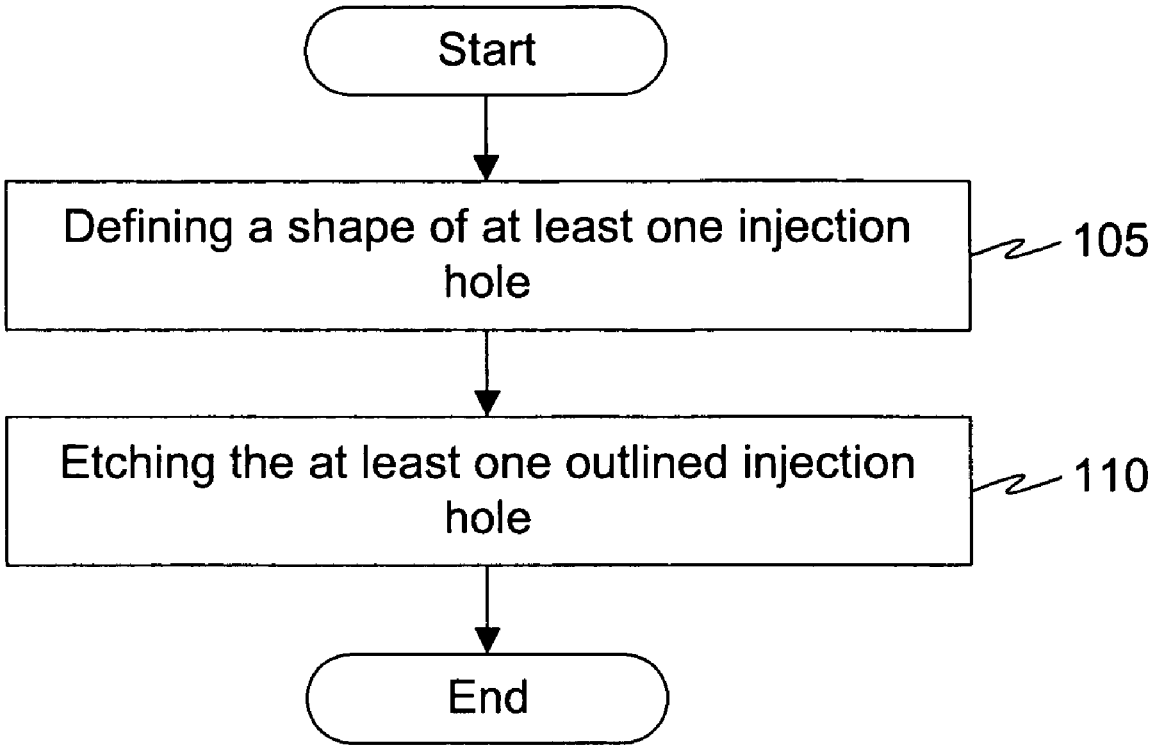
FIG. 1 illustrates a flow diagram depicting a method for manufacturing a fuel injector, in accordance with an embodiment of the present invention.

Referring now to the drawings, and in particular FIG. 1, a flow diagram depicting a method for manufacturing a fuel injector made of a glass substrate in accordance with an embodiment of the present invention. As stated earlier a few examples of such glass substrate can be fused silica, a fused quartz, any oxide glass ($B_2O_3$, $SiO_2$, GeO2, $P_2O_5$, $As_2O_3$, $Sb_2O_3$, etc.) or mixture of oxide glass; or any chalcogenides or halides glass, etc. The manufacturing method comprises machining the glass substrate of a predetermined thickness. At step 105, the method comprises defining a shape of at least one injection hole in a glass substrate to obtain at least one outlined injection hole. In an embodiment of the invention the step 105 of defining the shape of the at least one injection hole in the glass substrate to obtain the at least one outlined injection hole can be enabled using a laser. At step 110, the method comprises etching the at least one outlined injection hole to provide the at least one injection hole. The etching step 110, further comprises treating the outlined injection hole with an acid solution. The acid solution comprises hydrofluoric acid, or combination of acids including among other components hydrofluoric acid. The hydrofluoric acid etches preferentially the regions that have been laser exposed, therefore creating the desired injection hole.

Figure 2:
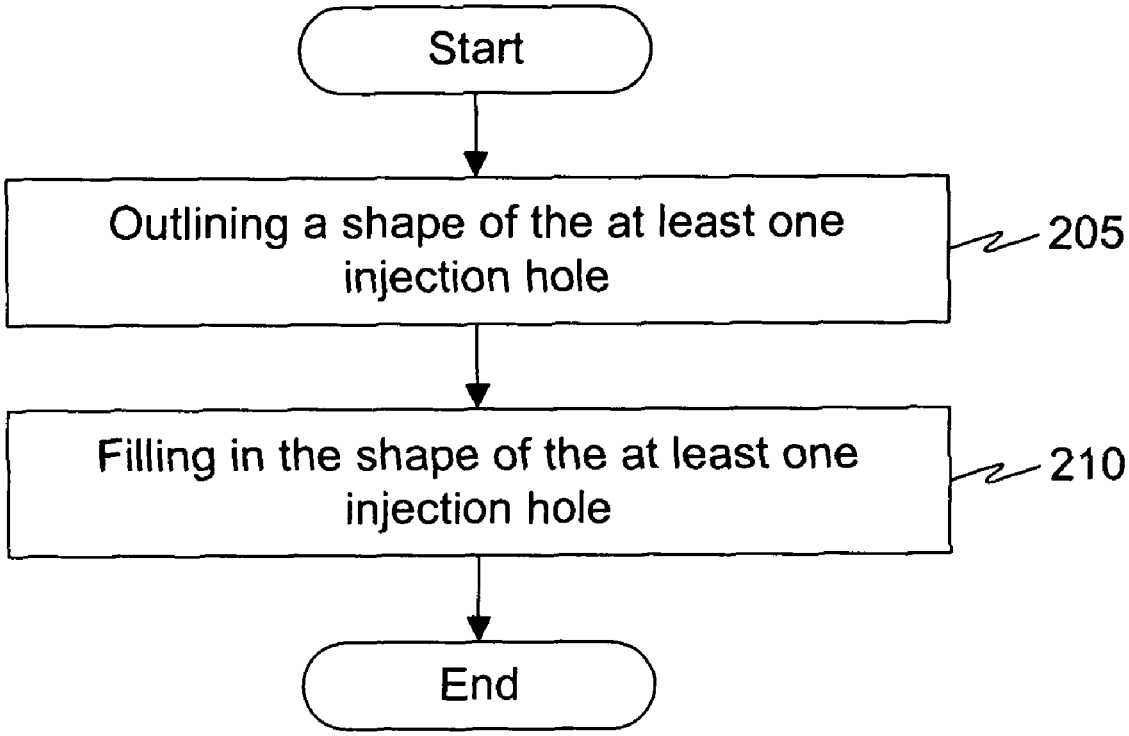
FIG. 2 illustrates a flow diagram depicting a method for defining a shape of an injection hole in a fuel injector, in accordance with another embodiment of the present invention.

Referring now to FIG. 2, a flow diagram depicting a method for defining a shape of an injection hole in a fuel injector, is in accordance with another embodiment of the present invention. The method elaborates the step of defining the shape of the at least one injection hole in a glass substrate. The defining step comprises at step 205, outlining the shape of the at least one injection. The outlining step further comprises outlining at least one additional surface beyond a boundary of the at least one injection hole, wherein the at least one additional surface is of a complex three-dimensional piece. The outlining step is enabled using a laser. The laser used in the outlining step 205, can be one of a many of possible choices among ultrafast lasers generating ultrashort pulses. The laser must operate at a wavelength where the glass substrate is transparent, i.e. the glass must have no or very little linear absorption (one-photon absorption) at the laser wavelength. Furthermore, the laser pulses must be sufficiently intense to deposit energy into the glass through non-linear absorption (multiphoton absorption) at the point of interest (typically the focal spot). Several holes can be outlined on the same glass substrate piece.

The defining step further comprises at step 210 filling in the shape of the at least one injection hole. The filling in step comprises defining a full volume of the injection hole, rather than just the outside surfaces of the injection hole. Those of skill in the art will appreciate that the present invention can be embodied in various forms.

Figure 3:
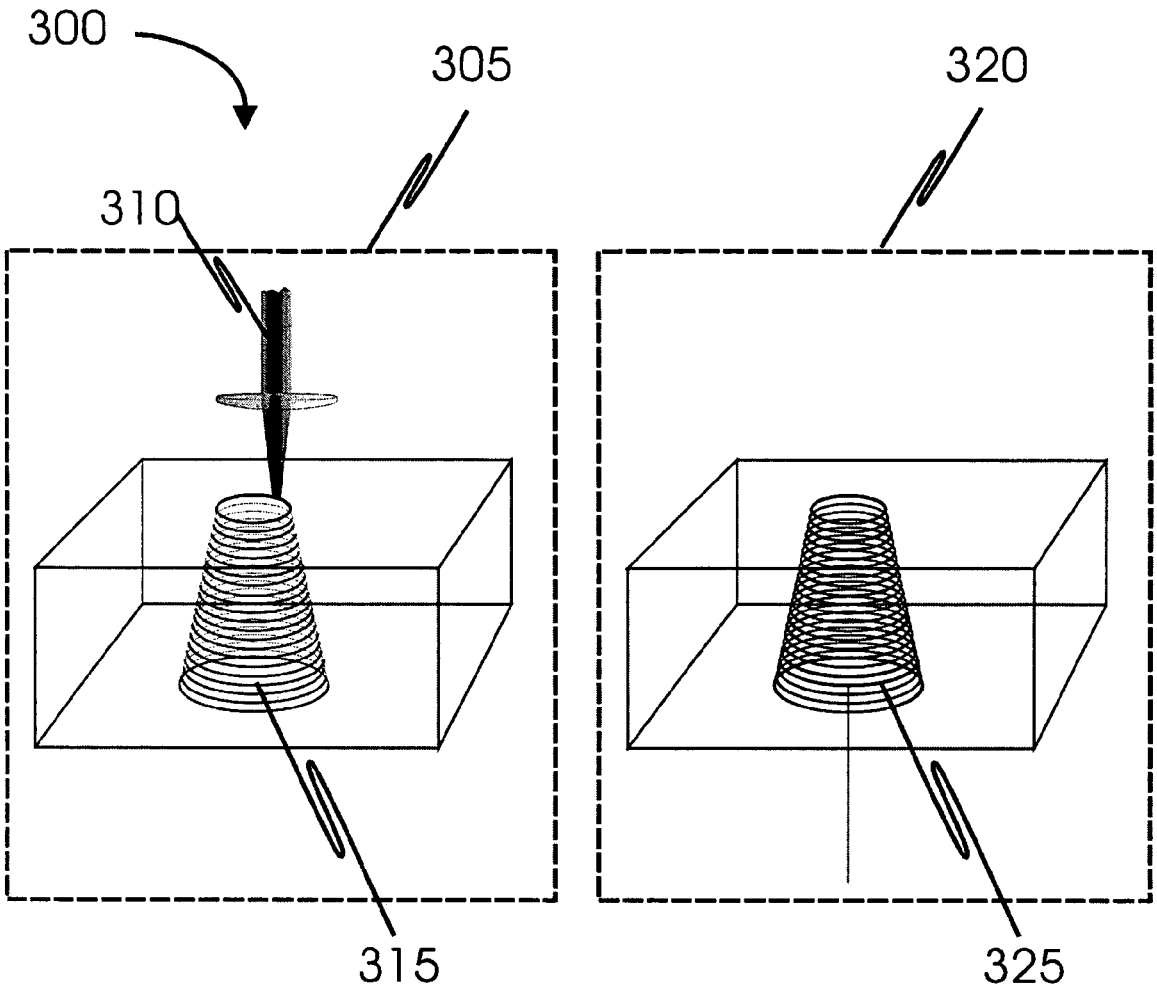
FIG. 3 is a schematic diagram of the manufacturing process, in accordance with an embodiment of the invention.

FIG. 3 is a schematic diagram 300 of the manufacturing process, in accordance with an embodiment of the invention. A block 305 comprising, a laser outlining process using a laser 310, whereby an outline 315 gets created on the glass substrate. A block 320 comprises, a resulting etched volume 325 in a glass substrate that is generated after the outlined injection hole is treated with a hydrofluoric acid solution.

Figure 4:
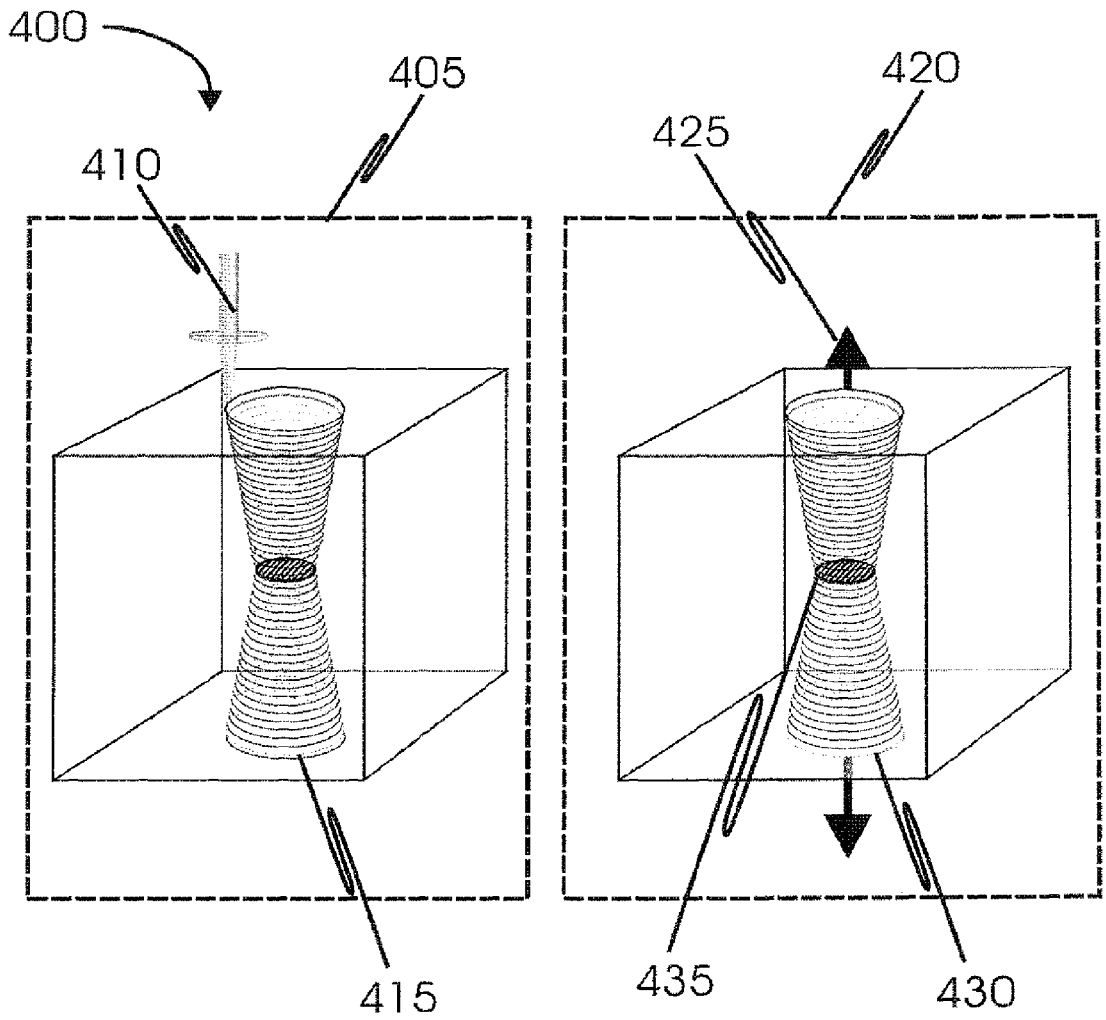
FIG. 4 is a schematic diagram of the manufacturing process, in accordance with another embodiment of the invention.

A schematic diagram 400 of the manufacturing process, in accordance with another embodiment of the invention is shown in FIG. 4. The figure is an illustration of the manufacturing process for a complex 3D glass substrate piece. A block 405 comprises, a laser outlining process using a laser 410, whereby an outline 415 gets created on the glass substrate. A block 420 comprises, a resulting etched volume in a glass substrate that is generated after the outlined injection hole is treated with a hydrofluoric acid solution. The etched volume in the complex 3D glass substrate piece can be divided in two parts 425 and 430 by a surface 435 that traverses across the volume as shown in block 420 so that the parts 425 and 430 can be extracted. The division is obtained by outlining and forming with the laser the surface 435 that is etched away, thus providing a dividing surface that is required to separate and extract parts 425 and 430.

Figure 5:
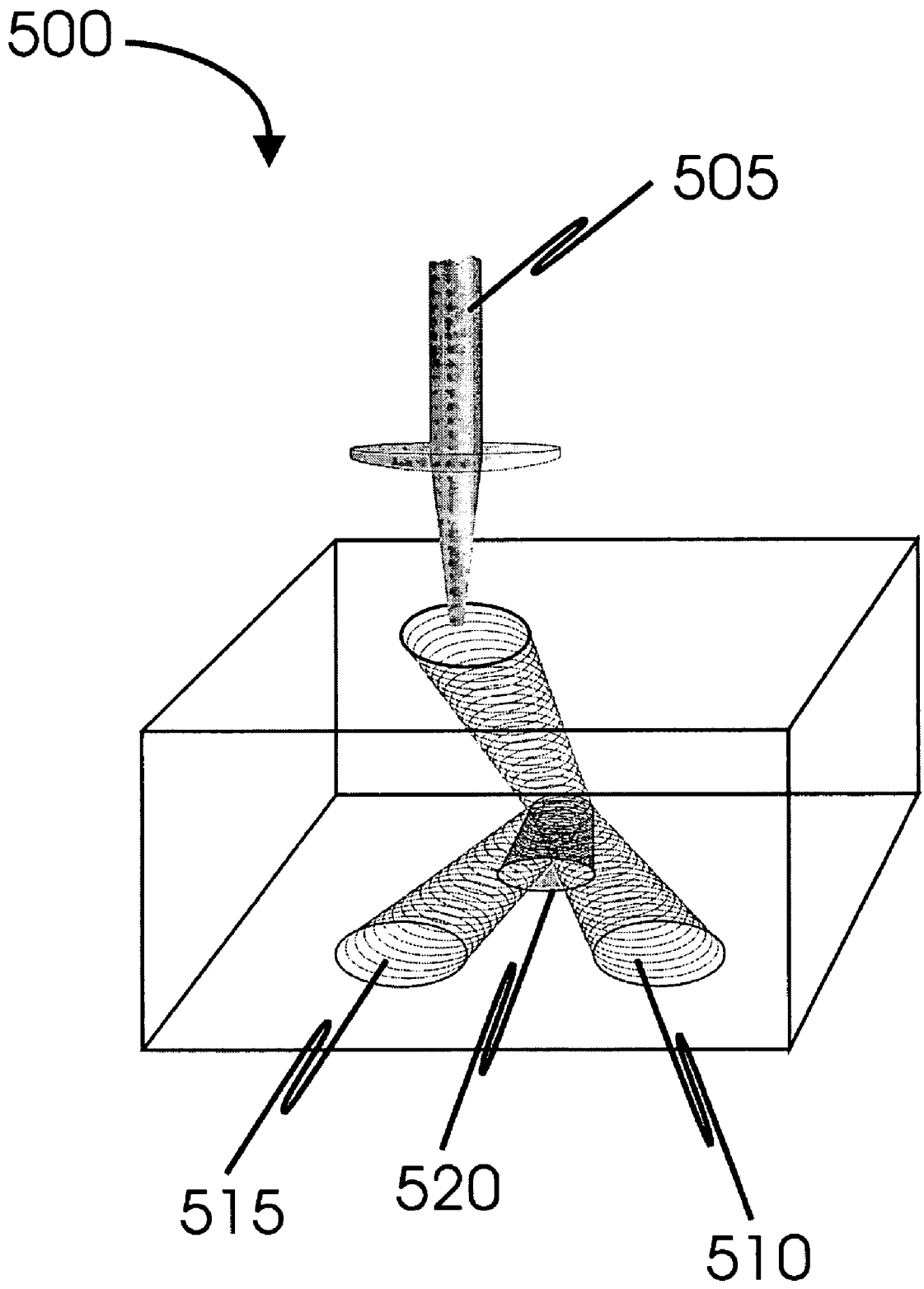
FIG. 5 is a schematic diagram of the manufacturing of complex three-dimensional shape, in accordance with an embodiment of the invention.

FIG. 5 is a schematic diagram 500 of the manufacturing of complex three-dimensional shape, in accordance with an embodiment of the invention. The schematic diagram depicts a laser outlining process using a laser 505, whereby one can form a plurality of injection holes that are combined in group with various relative orientation such as a tree-shaped created on the glass substrate as depicted by 510, 515 and 520. The plurality of injection holes that are combined in group with various relative orientation can be a plurality of twisted or helical holes, a plurality of venturi-shaped holes, a plurality of hour-glass shaped holes, a plurality of large holes with various types of internal baffles, etc.

Figure 6:
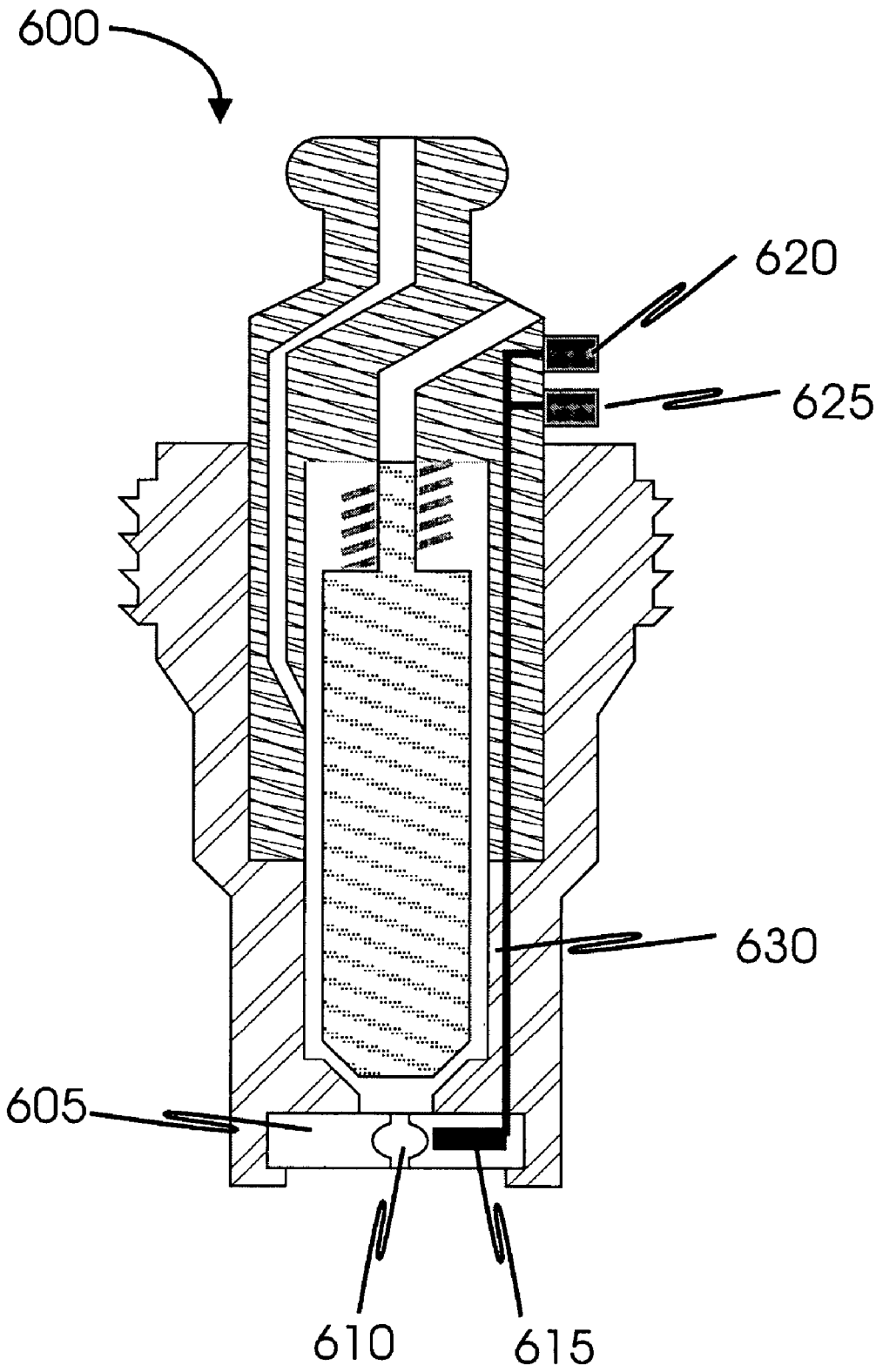
FIG. 6 is a schematic diagram of the apparatus demonstrating a fuel injector made of a glass substrate, in accordance with an embodiment of the invention.

FIG. 6 is a schematic diagram 600 of a fuel injector made of a glass substrate, in accordance with an embodiment of the invention. Fuel injector 600 comprises a glass substrate 605 and a nozzle 610 enclosed within glass substrate 605. Nozzle 610 comprises at least one injection hole. Glass substrate 605 comprises one of a fused silica component, a glass, and a fused quartz. Fuel injector 600 further comprises a plurality of optical wave-guides 615. Plurality of optical wave-guides 615 enable determination of atomization properties of a fuel spray. Fuel injector 600 further comprises at least one light source 620 coupled with glass substrate 605 to emit an optical signal. Fuel injector 600 also comprises at least one photodetector or an optical detector 625 coupled with glass substrate 605 to detect the optical signal. Plurality of optical wave-guides 615 is enabled to guide the optical signal from light source 620 via fiber 630 to a fuel spray and control the optical signal. Fuel injector 600 additionally comprises a fiber 630. Fiber 630 carries light from light source 620 to plurality of optical wave-guides 615 and then back to photodetector 625. This allows the photodetector 625 and light source 620 to be kept away from the destructive heat of the engine.

The present invention allows fabrication of complex three-dimensional shaped injection holes that enables an optimal atomization, an optimal fuel distribution within a cylinder, and a minimum fuel cavitation. Since the fuel injector is made of a glass substrate it removes any manufacturing complexities involved and allows for the direct optical observation of the combustion chamber, fuel-burning processes, measurement of the speed of the spray and the atomization process and direct observation of nozzle wear.

The fuel injector nozzle is compatible with all fuels and fuel additives. The process used to manufacture the fuel injector is such that it does not create micro-crack in the glass substrate and as a result enables high material strength. For example the elastic limit can be greater than 2 GPa. It may also eliminate pre-existing micro-cracks in the glass substrate. This results in a considerable increase in the ultimate elastic limit of the glass substrate.

What is claimed is:

1. A method for manufacturing a fuel injector having a nozzle, the method comprising steps of:

depositing energy in a glass substrate through multi-photon absorption at a wavelength at which the glass substrate is transparent to define an outline of an injection hole of the nozzle within the glass substrate; the depositing step comprising depositing the energy in the glass substrate to form a dividing surface that traverses across a volume defined by the outline to divide the volume into first and second parts;

etching the glass substrate at the outline, the etching step comprising etching the glass substrate at the dividing surface to separate the first and second parts of the volume; and extracting the first and second parts of the volume from the glass substrate to create the injection hole.

2. The method of claim 1, wherein the depositing step comprises:

defining a shape of the volume to be removed from the glass substrate to form the injection hole.

3. The method of claim 1, wherein the depositing step comprises:

exposing the glass substrate to the energy in a region within the outline of the injection hole.

4. The method of claim 3, wherein the exposing step comprises defining a complex three-dimensional piece of the glass substrate within the outline of the injection hole.

5. The method of claim 1, wherein the depositing step comprises exposing the glass substrate with a laser.

6. The method of claim 1, wherein the depositing step comprises:

generating ultrashort pulses through a laser to define the outline of the injection hole.

7. The method of claim 1, wherein the etching step further comprises treating the outline of the injection hole with an acid solution.

8. The method of claim 7, wherein the acid solution comprises hydrofluoric acid.

9. A method for manufacturing a fuel injector nozzle, the method comprising steps of:

depositing energy in a glass substrate through multi-photon absorption at a wavelength at which the glass substrate is transparent to outline a volume of an injection hole of the fuel injector nozzle within the glass substrate and to form a dividing surface that traverses across the volume to divide the volume into first and second pads;

etching the glass substrate at the outline to provide the volume and at the dividing surface to separate the first and second parts of the volume; and extracting the first and second parts of the volume from the glass substrate to create the injection hole.

10. The method of claim 9, wherein the depositing step comprises generating ultrashort laser pulses to define the outline of the volume and the dividing surface.

11. The method of claim 9, wherein the etching step further comprises treating the outline of the volume and the dividing surface with an acid solution.

* * * * *

UNITED STATES PATENT AND TRADEMARK OFFICE

CERTIFICATE OF CORRECTION

PATENT NO. : 7,716,830 B2
APPLICATION NO. : 11/247907
DATED : May 18, 2010
INVENTOR(S) : Thomas F. Haddock et al.

It is certified that error appears in the above-identified patent and that said Letters Patent is hereby corrected as shown below:

Column 5, claim 9, line 8, please delete "pads" and replace with -- parts --.

Signed and Sealed this

Twenty-fourth Day of August, 2010

David J. Kappos

David J. Kappos
*Director of the United States Patent and Trademark Office*